United States Patent [19]

Johnson, Jr.

[11] Patent Number: 4,945,845

[45] Date of Patent: Aug. 7, 1990

[54] HIGH-SPEED SAILING CRAFT

[76] Inventor: James L. Johnson, Jr., 4031 S. Dakota Ave., N.E., Washington, D.C. 20018

[21] Appl. No.: 315,183

[22] Filed: Feb. 24, 1989

Related U.S. Application Data

[63] Continuation of Ser. No. 168,578, Mar. 7, 1988, abandoned, which is a continuation of Ser. No. 819,361, Jan. 16, 1986, abandoned.

[51] Int. Cl.[5] ..... B63H 9/04

[52] U.S. Cl. ..... 114/39.1; 114/90; 114/61

[58] Field of Search ..... 114/39.1, 61, 271, 274, 114/278, 43, 280–283, 102, 123, 89–91, 97, 98; 244/98, 218; 441/65, 68, 72, 73

[56] References Cited

U.S. PATENT DOCUMENTS

| | | | |
|---|---|---|---|
| 1,356,300 | 10/1920 | McIntyre et al. | 114/39 |
| 1,670,936 | 5/1928 | McIntyre et al. | 114/39 |
| 2,126,665 | 8/1938 | Rowland | 114/102 |
| 2,387,907 | 10/1945 | Hook | 114/276 |
| 2,756,711 | 7/1956 | Simpson | 114/274 X |
| 3,077,850 | 2/1963 | Beuby | 114/281 X |
| 3,295,487 | 1/1967 | Smith | 114/273 |
| 3,646,902 | 3/1972 | Smith | 114/280 |
| 3,762,353 | 10/1973 | Shutt | 114/281 X |
| 3,800,724 | 4/1974 | Tracey | 114/39 |
| 3,870,004 | 3/1975 | Bailey | 114/39 |
| 4,276,003 | 6/1981 | Krovina | 114/90 X |
| 4,280,428 | 7/1981 | Werner, Jr. | 114/39 |
| 4,584,957 | 4/1986 | Belvedere | 114/39 |

FOREIGN PATENT DOCUMENTS

| | | | |
|---|---|---|---|
| 20121 | 12/1980 | European Pat. Off. | 114/39.1 |
| 3234163 | 3/1984 | Fed. Rep. of Germany | 114/91 |
| 2498554 | 7/1982 | France | 114/102 |
| 2549443 | 1/1985 | France | 114/123 |
| 206283 | 11/1984 | Japan | 114/91 |

OTHER PUBLICATIONS

*Yachting World,* Nov. 1974, p. 95, picture of "Tackwing", upper right hand side.

Bradfield, W. S., "On the Design and Performance of Radical High-Speed Sailing Vehicles", *Marine Technology,* Jan. 1980, pp. 50–56.

"Flying Proa", *Sail,* Jan. 1985, p. 88.

"Sea Flier", *Sail,* Jan. 1985, p. 89.

"Physail", *Sail,* Jan. 1985, p. 91.

Russell, Diana, "Sailboards, Inventions, Yachts, and Exotic Craft", *The Seventh Chesapeake Sailing Yacht Symposium,* Jan. 1985.

Beyor, Charles, "Amaran", *Multihulls,* Jul./Aug. 1985, pp. 47–48.

*Primary Examiner*—Joseph F. Peters, Jr.
*Assistant Examiner*—Clifford T. Bartz

[57] ABSTRACT

A craft propelled by an inclined sail. Sail lift causes hull to be raised by rotating to windward about an outrigger borne by tandem surface boards, thus decreasing resistance.

9 Claims, 4 Drawing Sheets

FIG. 7
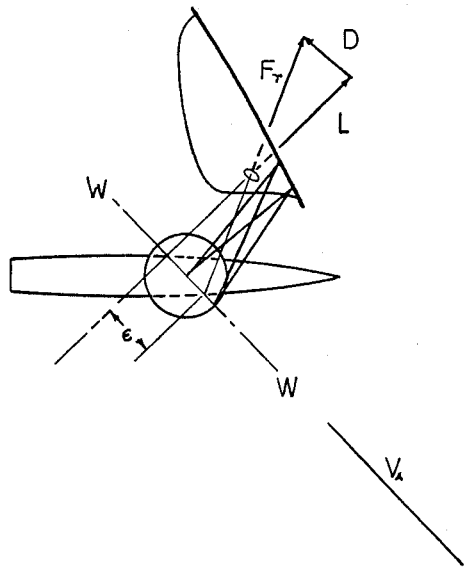
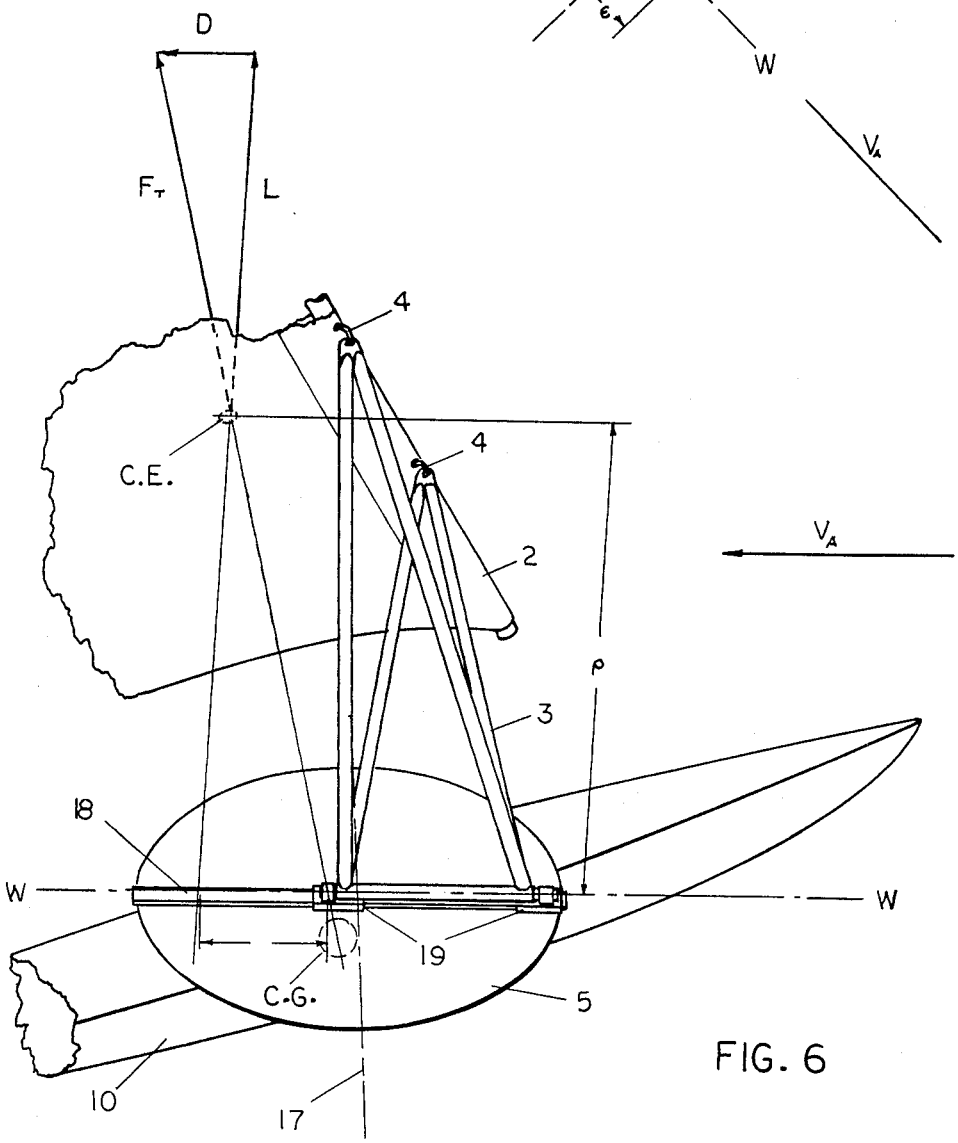
FIG. 6

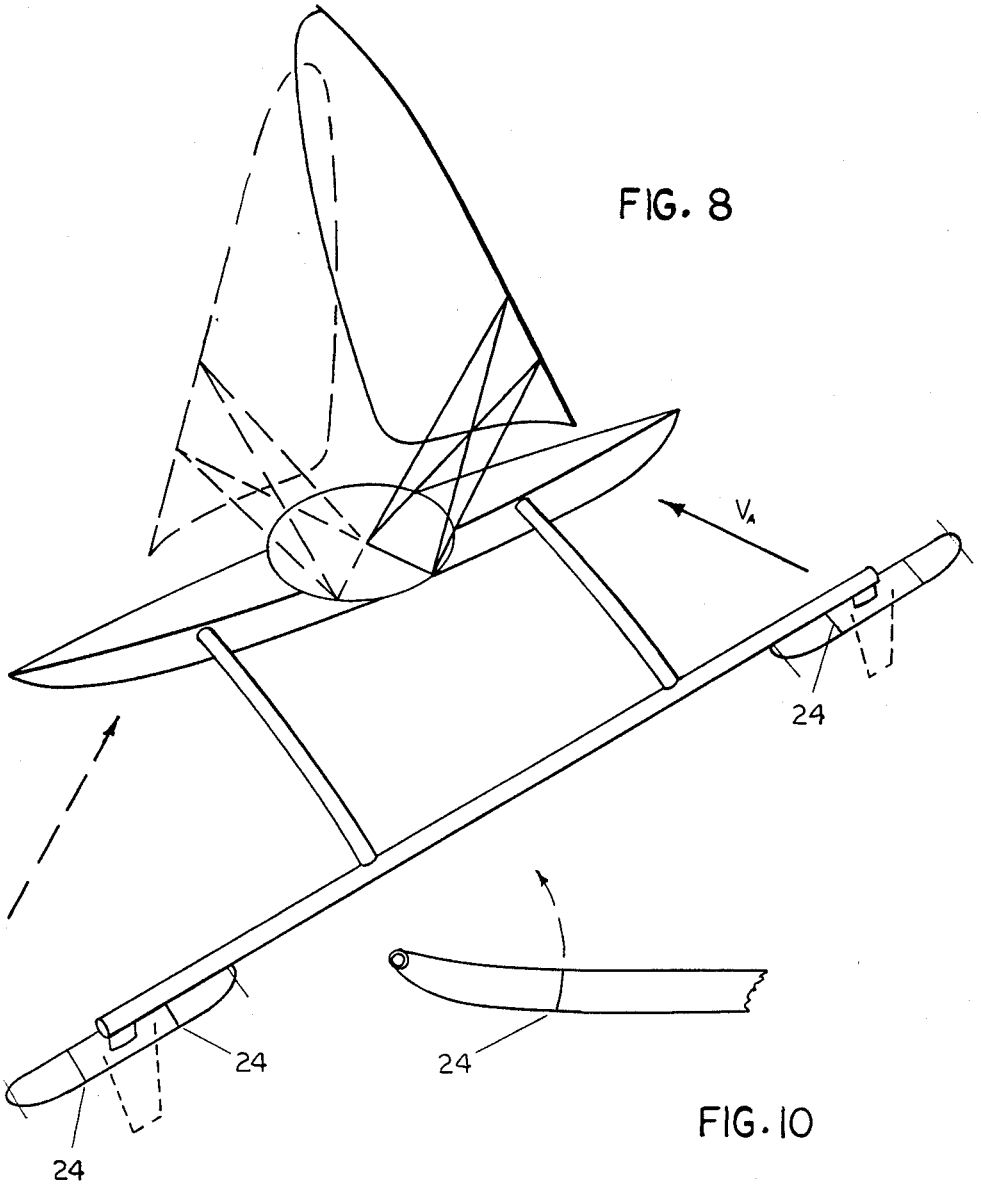
FIG. 8
FIG. 10
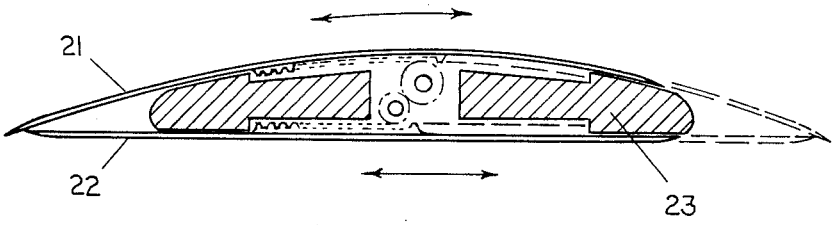
FIG. 9

HIGH-SPEED SAILING CRAFT

This application comprises a continuation of prior application entitled "A High-Speed Sailing Craft," Ser. No. 07/168,578, filed 03/07/88, abandoned, which was a continuation of "A High-Speed Sailing Craft," Ser. No. 06/819,361, filed 01/16/86, abandoned.

BACKGROUND OF THE INVENTION

The present invention is directed towards improvement in the speed of light sailing craft. First, there will be a brief discussion of the relationships involved in the propulsion of a sailboat.

FIG. 1 shows the relationship between the true wind velocity $\vec{V}_T$, at angle $\gamma$ to the boat velocity $\vec{V}_B$, and the apparent wind $\vec{V}_A$ which the boat encounters. $\vec{V}_A$ is the vector resultant of $\vec{V}_T$ and $-\vec{V}_B$, the induced velocity of the boat. It meets $\vec{V}_B$ at an angle $\beta$. Replacing the vectors in FIG. 1 by their scalar magnitudes and applying the law of sines, it can be shown that $$V_B/V_T = \sin\gamma \operatorname{ctn}\beta - \cos\gamma$$

However experience has shown that $V_B/V_T$, the ratio of boat speed to true wind speed, is maximum when the true wind $\vec{V}_T$ is approximately on the beam, which is to say that $\gamma \approx 90°$. For this condition it can be shown that $$V_B/V_T \approx \cot\beta$$

as shown in FIG. 2. It is evident that $V_B$ will not exceed 28 knots unless the boat is operated in a moderate gale or higher or unless $\beta$ can be reduced so that $$V_B/V_T > 1$$

From the velocity triangle it can also be shown that $V_A/V_T$, the ratio of apparent wind speed (which later will be shown to be of crucial importance) to true wind speed is maximum at $\gamma = 90°$ and increases as $\beta$ decreases. In brisk winds, however, if $\beta$ is reduced so that $V_A$ approaches the course direction, a very large transverse force, with accompanying large overturning moment, ensues and there results an increase in drag due to heel and due to the increased displacement that arises from the downward reaction of a sail inclined to leeward.

The resistance of a hull can be reduced if its displacement or its wetted surface is reduced. Both of these reductions can be achieved if the craft is lifted out of the water. Planing craft and hydrofoil craft exemplify the usual approach to this end; however, lifting can be accomplished more efficiently if aerodynamic, rather than hydrodynamic, means are used. The herein described invention combines aerodynamic propulsion, aerodynamic lifting and aerodynamic neutralization of moments to yield a sailing vessel of enhanced speed capability.

SUMMARY OF THE INVENTION

In the present invention, the objective of raising the hull is met by directing the vertical force of an inclined sail through the hull center of gravity and thereby causing it to be lifted and rotated to windward about a laterally displaced windward axis defined by widely spaced surface boards (aquaplanes) which constitute a stable reference platform. The surface boards are maintained against leeway by hydrofoils appended thereunder. A significant improvement over most prior applications arises from the fact that this aerodynamic lifting can be so directed that all moments are minimized and, by virtue of the stable reference platform, safe, controllable motion can more easily be maintained.

A physical quantity such as a force, having direction as well as magnitude, is known as a vector. It is represented by an arrow in the direction of the quantity and of length proportional to the magnitude of the quantity. The direction of a vector passing through any point such as the sail center of effort can be extended indefinitely. Such an extension of a vector is termed its line of action. It will be shown that the present invention facilitates directing the line of action of the sail force through the hull center of gravity and through the approximate center of hydrodynamic resistance of immersed portions of the craft, thus nullifying the rolling, pitching, and yawing moments which tend to degrade the performance and impair the controllability of most previous craft which utilize aerodynamic lifting.

The total force on an inclined sail can be decomposed into a vertical force and two horizontal forces. The vertical force serves to reduce the hull displacement. The horizontal forces are conveniently taken along and at right angles to the course. The coursewise force is expended in overcoming the hydrodynamic drag of the hull and its submerged appendages and in overcoming the coursewise component of parasitic aerodynamic drag (the windage of exposed parts of the craft). Lateral components of parasitic drag contribute to the total leeway force applied to the water-borne portions of the craft.

In the present invention, these water-borne portions incorporate features which decrease the drag induced by the relatively large leeway force that results from sailing close to the apparent wind.

The first embodiment of this invention (now under construction) will operate most effectively only on the starboard tack. Another embodiment will be described, however, which extends the invention's principles to a more general sailing course.

BRIEF DESCRIPTION OF DRAWINGS

FIG. 6 shows the force vector relationships at the turntable to be mentioned below.

FIG. 7 is a plan view giving additional information on the quantity $\epsilon$ to be described below.

FIG. 8 shows a longitudinally symmetric embodiment.

FIG. 9 shows a proposed reversible hydrofoil.

FIG. 10 shows a means for alternative establishment of a transom at either end of a double-ended surface board.

DESCRIPTION OF FIRST EMBODIMENT

Figure 3:
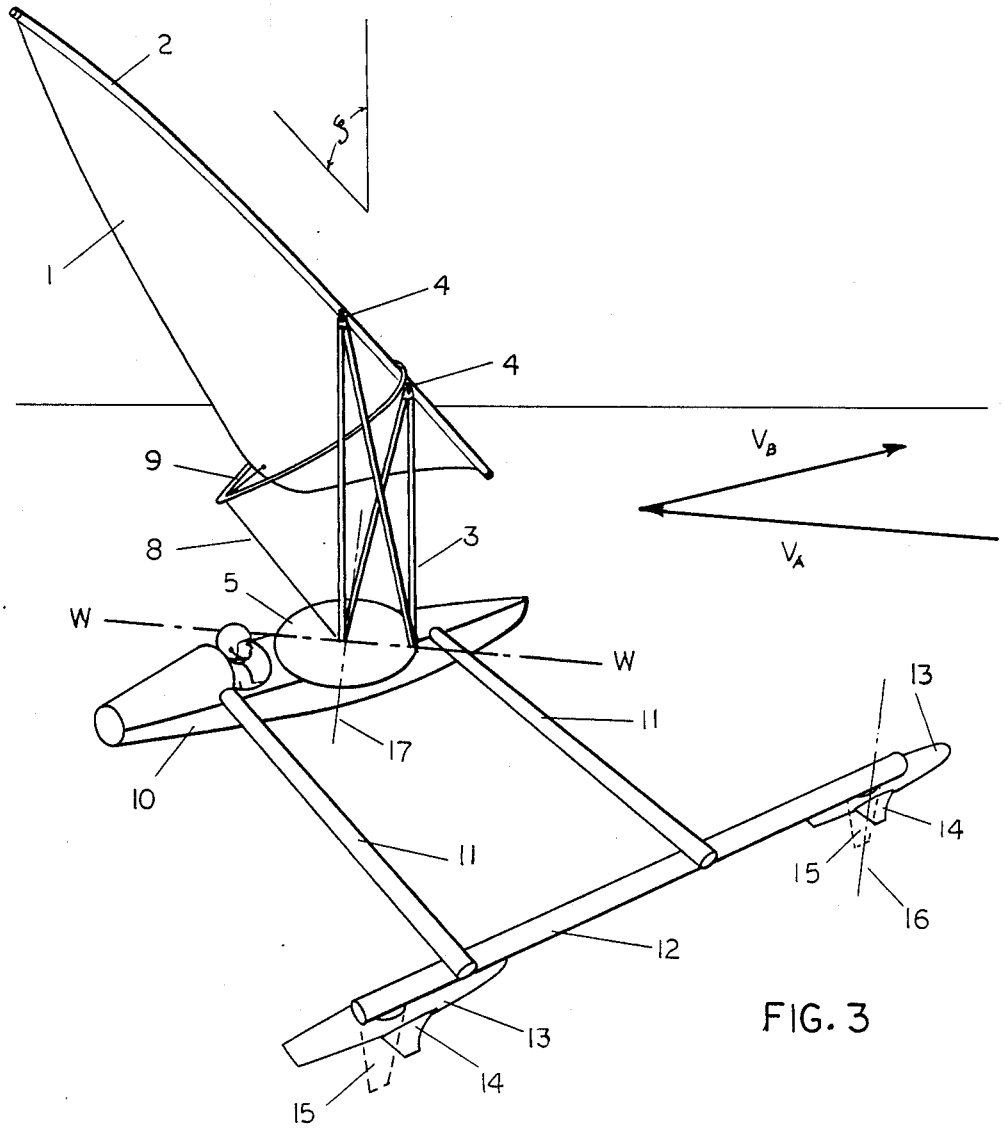
FIG. 3 is a perspective view of the craft in motion.
Figure 4:
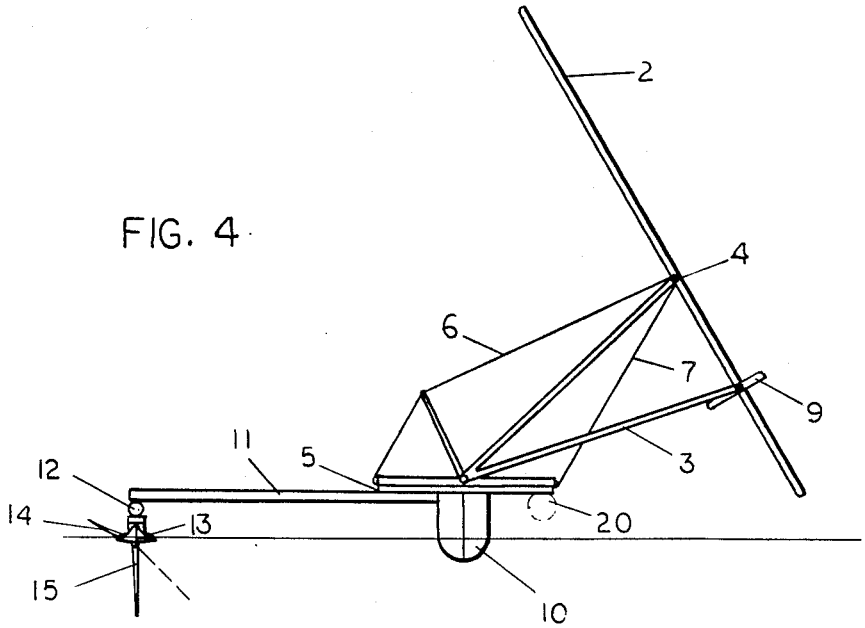
FIG. 4 is a bow elevation.
Figure 5:
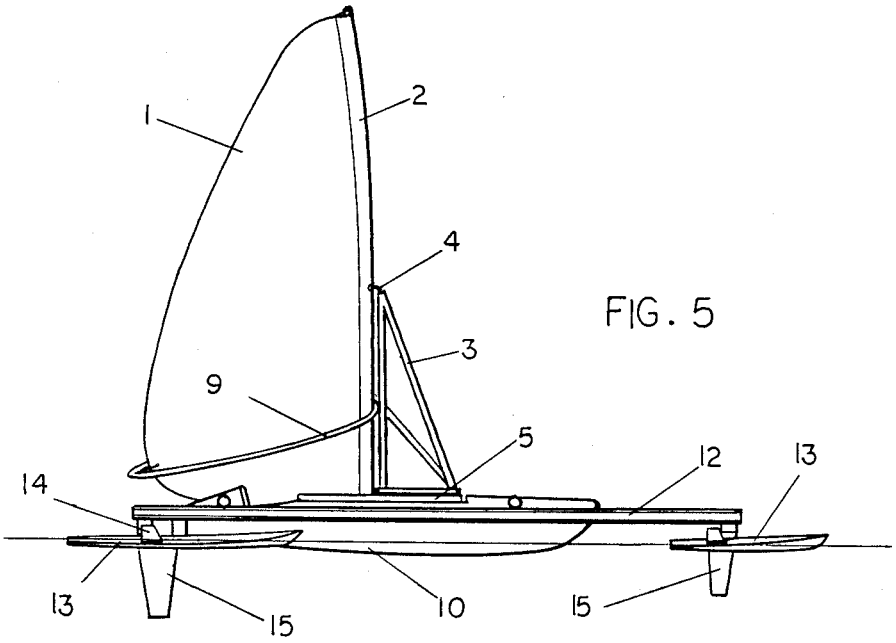
FIG. 5 is a starboard side elevation of a slightly different version.

FIG. 3 shows a perspective view of the craft sailing with the wind on the starboard bow. FIGS. 4 and 5 are bow and starboard side elevations, respectively. Element 1 is a sail, the mast 2 of which is inclined at an angle $\zeta$ to the vertical. This inclination is accomplished by rotation of the crane 3—to which the mast is attached at the spanwise location of the sail center of effort by means of pivots 4—about a horizontal axis W—W at its lower end which rotates about a vertical axis 17 established by a rotary means such as a turntable 5. $\zeta$ is controlled by halyards 6 and 7. The crane comprises an elongated tetrahedral truss in which the opposite shorter members lie virtually within the mast axis and the horizontal axis below, both axes being approximately perpendicular to each other and approximately perpendicular to a medial line through the assemblage comprising the four long members of the truss, the long members being essentially of equal length (see FIGS. 3, 6 and 7). Under normal operating conditions axis W—W is maintained parallel to the direction of the apparent wind. The sail incidence angle is controlled by sheet 8 attached at the aft end of the sail wishboom 9 and passing to a fairlead approximately at the center of the turntable. The sheet may be single as shown or double as in the case of a conventional jib.

Turntable 5 is mounted approximately amidships on the hull 10, which may be provided with a cockpit to shelter the operator and, also thereby, minimize windage. Extended from the hull are one or more crossbeams 11 which are connected to the upper surface of a longitudinal beam 12 which is supported by two relatively small surface boards (aquaplanes) 13, one at each end. The longitudinal beam is much longer than the crossbeams and it extends ahead of the bow of the hull. The surface boards are similar to displacement type sailboards, but each has a wing-like protuberance 14 angled up on the outboard side. Below each surface board is a hydrofoil 15 which can be adjusted to vary its dihedral angle or angle of cant about the direction of motion. This adjustment can be automatic, between two extreme positions, or it can be controlled by the operator, using such actuators as are common to the state of the art. Steering is accomplished by rotating the forward surface board about vertical axis 16.

PRINCIPLES OF OPERATION

Figure 1:
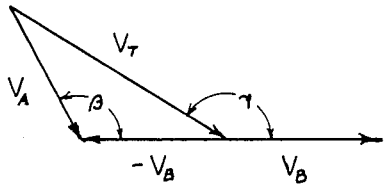
FIG. 1 shows the velocity triangle.
Figure 2:
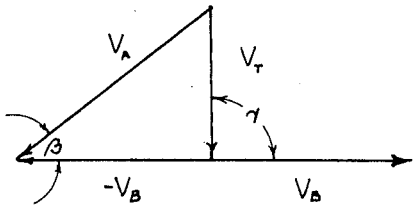
FIG. 2 is the velocity triangle for $\gamma = 90°$.

It can be shown that the lift produced by a wing is maximum when the span is normal to the oncoming airflow. Hence it is desirable that the wing (or sail) be maintained at such an attitude that the span is normal to the apparent wind, already mentioned in connection with FIG. 1. Means must be provided to monitor the orientation of axis W—W and to maintain it in alignment with the apparent wind. This is the ideal condition; however it will on occasion be necessary to introduce some misalignment in order to minimize yawing moments. More will be said below in regard to balance in yaw.

It is well at this point to define what is meant by saying that W—W is in alignment with the apparent wind. Clearly this alignment is easily achieved when the boat is upright. If, however, the boat is heeled to windward, as will be mentioned below, only the horizontal component of a vector along W—W can be parallel to the horizontal wind vector $\vec{V}_A$. For the present it will be assumed that the inclination of W—W is sufficiently small to be neglected. Further along, the full implication of the inclination will be stated and appropriate corrections therefore will be proposed.

It can be shown that if the mast is normal to the apparent wind, the lift force will be constant for a given sail incidence setting, regardless of the angle $\zeta$ to which the mast is tilted. The apparent wind can be considered as an infinite bundle of velocity filaments parellel to axis W—W. We can rotate the mast to an angle $\zeta$ about the filament through the center of effort, or about any other filament, say that which coincides with axis W—W, maintaining the sail angle of incidence relative to the filament constant and, thereby, the lift vector $\vec{L}$, by definition normal to the apparent wind, would sweep out a plane normal to the filament (it is important here that we distinguish between the sail lift vector L, which may be inclined at an angle $\zeta$ to the horizontal, and its vertical component L sin$\zeta$ which tends to lift the hull).

By design, the mast 2, attached to the upper part of the crane 3, its mounting centered opposite the sail center of effort, is normal to the centerline of the crane intersecting axis W—W. Hence, the lift vector $\vec{L}$ is not only normal to the apparent wind, but it is parallel to the centerline of the crane and it is normal to and intersects axis W—W. The line of action of the sail total or resultant force $\vec{F}_T$ also lies in the plane of $\vec{L}$ and W—W, but it extends outward and to leeward of the center of effort at an angle arcctn L/D, where D is the aerodynamic drag of the sail system. Thus, as shown in FIG. 6, the intersection of $\vec{F}_T$ with W—W falls to windward of the plane of $\vec{L}$. For level trim it is desirable that $\vec{F}_T$ intersect the longitudinal center of gravity of the airborne hull; otherwise the resulting pitching moment will have to be opposed by the two surface boards 13, which, for this reason and others, should be as far apart as is structurally feasible. Means are to be provided to adjust the longitudinal position of turntable axis 17 to correct any gross imbalance, and additional means, to control length $\epsilon$ as required. The length $\epsilon$, shown in FIG. 6, is the distance from the projection of the sail center of effort on axis W—W to the intersection of the total force line of action with axis W—W.

$$\epsilon = \rho / L / D$$

where $\rho$ is the radial distance of the center of effort from axis W—W. For this purpose the first design will utilize a track with tandem sliders 19 at the base of the crane assembly. Depending on the wind direction $\beta$, $\epsilon$ will displace the foot of the total force line of action laterally as well as longitudinally (see FIG. 7).

With the resultant force vector properly directed as described above, there will be no change in longitudinal trim as the hull rises from the water. Laterally, however, there will be a windward rolling of the entire craft about a line defined by the tandem surface boards 13, accompanied by a shifting of the center of resistance as coursewise components of hull resistance are diminished and the respective lateral and coursewise hydrofoil lift and induced drag components are increased.

It is said that fast sailing craft tend to operate at a constant value of apparent wind angle $\beta$. A constant apparent wind angle would facilitate maintenance of a constant line of action for the aerodynamic resultant force. This, in turn, would facilitate the balancing of yaw momints. Appreciable variation in $\beta$, combined with the aforementioned shift in center of resistance, may require a variation from the prescribed windward orientation of W—W to some heading that affords optimal balance in yaw.

The surface boards serve as a stable reference for the flying mainhull, but, moreover, they serve as endplates for the leeway-resisting hydrofoils 15, not only increasing their effective aspect ratio and, thus, reducing their induced drag, but also serving to minimize air entrainment which would otherwise occur at the juncture of the foils with the water surface. For stability in pitch and in yaw it is advantageous that the surface boards be as far apart as possible, consistent with structural weight limitations. In this initial design the center of gravity of the mainhull will be located so that most of the weight, perhaps two-thirds of the total, will be borne by the aft board. The relative buoyancies and areas will be proportioned accordingly.

The two wing-like protuberances 14 are intended to lie above the water when the craft is level, but as it inclines they become planing surfaces of reduced area, tending to sustain the entire water-borne system and reducing its wetted surface to a minimum. The wings 14 shown in FIGS. 3 through 5 should be considered only as one possible approach to this function. However, above all, care must be taken that means for surface reduction do not excessively impair the endplate effect just mentioned.

The fundamental desirability of maintaining the mast inclination axis parallel to the apparent wind has been shown above. Such alignment can be accomplished manually, or by means of mechanical, electrical, hydraulic or pneumatic actuators, or, aerodynamically, by means of vanes or other wind-actuated devices.

It will be apparent from examination of FIG. 4 that the lateral center of gravity of the craft must lie between the hull and the center of buoyancy of the surface board system if the craft is to remain upright when at rest, and, in order to guard against inadvertent capsizing, it would be prudent to provide a sponson or inflatable bag 20 at an appropriate location on the leeward side of the hull.

The Inclination of Axis W—W

Aligning axis W—W with the apparent wind and neglecting vertical inclination of W—W, it can be shown that the following equations determine the respective thrust, leeway, and vertical lift forces contributed by the sail system described in the preceding paragraphs:

$$F_x = L\sin\beta\cos\zeta - D\cos\beta$$

$$F_y = L\cos\beta\cos\zeta + D\sin\beta$$

$$F_z = L\sin\zeta$$

which agree with the conventional sailboat equations at $\zeta = 0°$. The requirement that W—W be aligned with the apparent wind assures that airflow will be normal to the sail span, which is to say that the flow will be chordwise. However, as the hull is rolled to an angle $\phi$ a certain amount of spanwise flow is developed, depending not only on the roll angle $\phi$, but also on the apparent wind angle $\beta$. In effect, the sail is no longer rotated only about the wind vector, but also towards the wind vector. Its projected area is decreased as cos $\phi$ and its normal component of velocity as cos $\phi$, so that the lift force L is now $L \cdot \cos^2\phi$. Inasmuch as drag is always in the direction of the apparent wind velocity, it is estimated that drag varies approximately as cos $\phi$.

Thus, a quantitative estimate of the effect of W—W inclination can be made by substituting the following quantities $L_e$ and $D_e$ for the respective L and D of the above force equations:

$$L_e = L[1-(1-\cos^2\phi)\sin\beta] = L(1-\sin^2\phi\cdot\sin\beta)$$

and $$D_e = D[1-(1-\cos\phi)\sin\beta]$$

THE PREFERRED EMBODIMENT

Expediency dictated that the first embodiment of this invention be in the form of the single-tack craft just described. It fully illustrates the principal concepts of the invention, namely, the use of an inclined sail system to lift a craft's hull and reduce its water-borne resistance by rotating it about a stable upwind axis maintained by widely-spaced tandem surface boards, constrained by appended hydrofoils. However illustrative, this is not the preferred embodiment. The preferred embodiment is a system founded on the same principles, but of longitudinal symmetry, namely, the proa—again with the surface boards always to windward. Owing to its bow to stern interchangeability, this craft would require reversible hydrofoils. The usual reversible hydrofoil is of circular arc section, sharp on both edges. Such a foil suffers leading edge separation when it is operated fully submerged. An improved reversible foil is shown in FIG. 9. This involves the use of sliding cover plates 21 and 22 which alternatively expose either rounded edge of an inner core member 23. In either extreme position the plates unite to form a sharp edge. A further extension of this principle would be to provide an interior channel and alternative intake and exhaust slots to achieve boundary layer control.

For the proa embodiment the surface boards would be longitudinally symmetric. Both ends would be curved in the fashion of the forward end of an unidirectional board, but at a short distance from either end there would be a transverse joint 24 and there would be means such that the curved end could be retracted upwardly, possibly as shown in FIG. 10, to establish a transom for efficient planing when the course is reversed, the transom being used at the trailing end.

Let it be understood that the foregoing description is only illustrative. It will suggest other embodiments to those skilled in the art, but it in no way limits the invention other than as defined by the claims as follows.

I claim:

1. A sailing vehicle comprising:

a. a person carrying hull;

b. at least one crossbeam attached to and extending approximately at right angles to windward of said hull and joining a longitudinal beam substantially parallel to the hull, said longitudinal beam surmounting two surface boards, otherwise known as aquaplanes, in tandem, one at each end, under each of which depends a hydrofoil;

c. an inclinable sail supported above the hull by a controllable rigid means such that both the position and angle of said sail can be varied over a wide range and such that said controllable rigid means is itself rotatable in azimuth so that the said sail angle variation can be achieved relative to any wind direction; whereby the purpose of said inclinable sail and controllable rigid means is to facilitate attainment of an optimal combination of propulsive and lifting forces directable in such a way as to maintain fast and stable operation.

2. The sailing vehicle of claim 1, in a longitudinally symmetric embodiment such that sailing can proceed with bow and stern interchanged, the aforesaid surface boards being maintained always to windward.

3. The sailing vessel of claim 2, wherein the aforesaid surface boards have substantially similar leading and trailing ends and wherein the said ends are smoothly curved but have a transverse joint permitting either curved end to be withdrawn from the water to expose a transom that facilitates efficient planing when the course is reversed, the transom being used at the trailing end.

4. The sailing vehicle of claim 1, wherein the aforesaid hydrofoils consist of blunt-edged cores of fore and aft symmetry, over which cover plates are moved in a fore and aft direction as required to generate sharp trailing edges.

5. The sailing vehicle of claim 1, wherein the said controllable rigid means of support comprises a crane having upper and lower ends, the upper end of said crane being terminated by an axis substantially perpendicular to the crane, along which axis and rotationally connected to the crane lies a mast about which the aforesaid sail can be deployed at varied angles; the lower end of said crane being mounted so as to rotate about a substantially horizontal axis approximately perpendicular to the aforesaid axis terminating the upper end of the crane, said substantially horizontal axis and attached crane being rotatable to any desired orientation with respect to the wind.

6. The sailing vehicle of claim 5, wherein the aforesaid crane comprises an elongated tetrahedral truss in which four substantially equal long members connect a short segment of the aforesaid mast axis with a short segment of the aforesaid substantially horizontal axis, said short axial segments comprising the remaining edges of the tetrahedron and being substantially perpendicular to each other and to a medial line through the truss.

7. The sailing vessel of claim 1, wherein means consisting of the aforesaid inclinable sail supported above the hull by the said controllable rigid means rotatable in azimuth is provided to propel the aforesaid hull and to raise it by causing it to rotate to windward about a laterally displaced windward axis defined by the aforesaid surface boards, said surface boards being separated by a longitudinal distance on the order of, and preferably exceeding, the length of the aforesaid hull.

8. The sailing vehicle of claim 1, wherein the aforesaid hydrofoils are controllable as to dihedral angle, said dihedral angle being the angle that the hydrofoil makes with respect to the horizontal, said angle being measured about an axis parallel to the direction of motion.

9. The sailing vehicle of claim 1, wherein the aforesaid hydrofoils automatically move between two extreme dihedral angle positions.

* * * * *